United States Patent [19]

Kurzbuch

[11] 4,358,979

[45] Nov. 16, 1982

[54] APPARATUS FOR CUTTING PLASTIC FILM

[75] Inventor: Werner Kurzbuch, Baton Rouge, La.

[73] Assignee: Exxon Research & Engineering Co., Florham Park, N.J.

[21] Appl. No.: 210,075

[22] Filed: Nov. 24, 1980

[51] Int. Cl.[3] ..... B26D 7/20; B26F 1/18

[52] U.S. Cl. ..... 83/658; 83/660; 83/140

[58] Field of Search ..... 83/140, 385, 386, 561, 83/562, 613, 658, 660, 666, 835; 156/513

[56] References Cited

U.S. PATENT DOCUMENTS

| | | | |
|---|---|---|---|
| 1,040,262 | 10/1912 | Berger | 83/658 |
| 1,123,386 | 6/1915 | Russell | 83/658 |
| 2,956,465 | 10/1960 | Mingo | 83/660 |
| 3,227,024 | 1/1966 | Krebs | 83/658 X |
| 3,270,607 | 9/1966 | Oesterreicher | 83/658 |
| 3,473,995 | 10/1969 | Schott | 156/513 |
| 3,626,799 | 12/1971 | Gerber | 83/658 X |
| 3,686,988 | 8/1972 | Ross | 83/660 X |
| 3,732,771 | 5/1973 | Kinoshita et al. | 83/663 X |
| 3,775,225 | 11/1973 | Schott | 83/627 X |
| 3,781,124 | 12/1973 | Bodycomb | 83/658 X |
| 3,795,163 | 5/1974 | Armstrong | 83/678 X |

*Primary Examiner*—Stephen G. Kunin
*Assistant Examiner*—Robert P. Olszewski
*Attorney, Agent, or Firm*—R. L. Graham

[57] ABSTRACT

Apparatus for cutting plastic film having a serrated chromium plated cutting blade and a readily penetrable film back-up member, preferably balsa wood, aligned with the cutting blade. The back-up member has grooves formed therein by the penetrating action of the blade.

11 Claims, 2 Drawing Figures

APPARATUS FOR CUTTING PLASTIC FILM

BACKGROUND OF THE INVENTION

1. Field of the Invention

This invention relates generally to apparatus for cutting plastic films. In one aspect, the invention relates to apparatus for perforating thermoplastic films in the manufacture of plastic bags.

2. Description of the Prior Art

In the manufacture of bottom sealed plastic bags, it is necessary to process the bag through an apparatus which produces a heat seal and an adjacent perforated line across the tubular film. The heat seal provides the bottom closure for one bag and the perforations permit the adjacent bag to be separated by tearing along the perforations. The perforated web must have sufficient strength to maintain integrity until it is desired to separate the bags.

One common technique for heat sealing and perforating the bags is to index the tubular film as it emerges from the blown film extrusion system through an in-line bag machine, which is provided with a reciprocating serrated blade and sealing element. With a portion of the flattened film positioned in the bag machine, the blade and heat sealing assembly is actuated. The assembly moves downwardly to cause the heating element to engage the film and the blade to penetrate the film. The assembly then moves upwardly to the retracted position permitting the film to be indexed to the next position, wherein the heat sealing and perforation cycle is repeated. A commercially available machine that operates in this manner is the Gloucester Universal Bag Machine, marketed by Gloucester Engineering Co., Inc., located in Gloucester, Mass.

The in-line bag machine, as described above, functions satisfactorily for many types of film such as low density polyethylene (LDPE) film. However, it has been found that machines of this type are not satisfactory for linear low density polyethylene (LLDPE) film. Experience with LLDPE has shown that it is important that the blades maintain their sharpness to provide satisfactory penetration. It is believed that the superior physical properties of LLDPE over LDPE is much more sensitive to blade sharpness. When the blade becomes even slightly dulled, it tends to push the film downwardly into the slot underlying the film and aligned with the cutting blade, resulting in incomplete perforations. Moreover, the downward pushing action increases the film tension in the heat sealing region and adversely affects the quality of the seal attainable.

SUMMARY OF THE INVENTION

The purpose of the present invention is to provide an improved apparatus for cutting or perforating plastic film, particularly linear low density polyethylene. In its broadest form, the apparatus comprises a metal blade having a serrated cutting edge; a back-up member aligned with the blade and having a surface for supporting the film thereon; and means for reciprocating the blade through a cutting cycle to penetrate the film and the back-up member. The back-up member includes particularly shaped grooves formed therein to receive the serrated cutting edge in close conformity. In a preferred embodiment, the back-up surface is provided by a material which has sufficient rigidity in the cutting direction to support the film but is readily penetrable by the cutting blade. Suitable back-up materials include balsa wood, and resinous material such as polyurethane foam, with balsa wood being the preferred material.

In order to impart sufficient life to the blades before they become dull, it is preferred that they be composed of a metal having a hardness of at least Rockwell C 50. A particularly suitable blade is a metal blade having the cutting edge thereof flash coated with chromium by electroplating process.

Tests using the apparatus constructed according to the present invention have shown that substantially longer blade life is experienced when used in perforating linear low density polyethylene than is possible with the conventional cutting apparatus of the Gloucester Universal Bag Machine.

The apparatus according to the present invention is particularly useful in the bag machines equipped with a sealing element, since the back-up support surface prevents film tensioning in the vicinity of the sealing zone.

DESCRIPTION OF THE PREFERRED EMBODIMENTS

As mentioned previously, the present invention provides an improved apparatus for cutting plastic film which is particularly suitable for cutting linear low density polyethylene (LLDPE) film. The term "plastic", as used herein, means a material containing an organic substance of large molecular weight which is solid in its final condition and which at some earlier time was shaped by flow. The term "film" means thin sections of polymers. Films are generally available in thicknesses of between 0.5 to 10 mils.

LLDPE is a class of ethylene-alpha-olefin copolymers which may be produced by low pressure operations. Several companies currently market LLDPE. The properties of LLDPE differ markedly from other polymers of ethylene. It is stronger than low density polyethylene because of the linear nature of the polymer molecules and for that reason is more difficult to process.

Figure 1:
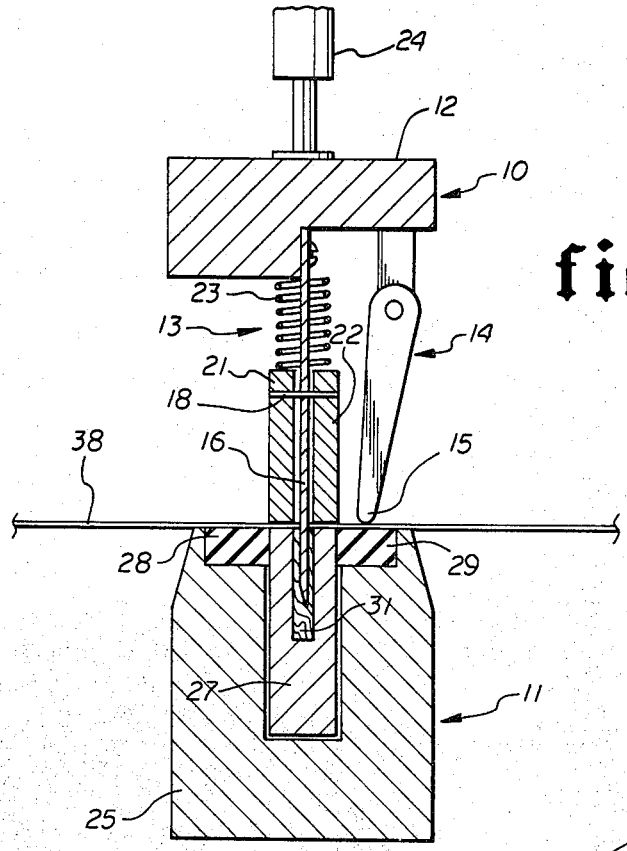
FIG. 1 is a side elevation schematic of the apparatus constructed according to the present invention.

Referring to FIG. 1, the cutting apparatus of the present invention comprises an upper head assembly 10 and lower bar assembly 11. The assemblies 10 and 11 are mounted on suitable frame (not shown) to maintain proper alignment.

The head assembly 10 includes a head member 12 on which are mounted a blade assembly 13 and heat sealing assembly 14. The heat sealing assembly is provided with an electric heating element 15 and controls (not shown) for maintaining the desired temperature. The heating assembly 14 may be of construction well known in the art. For example, the Gloucester Universal Bag Machine is provided with resistance-type heating elements and thermocouple controls (see U.S. Pat. No. 3,775,225).

Figure 2:
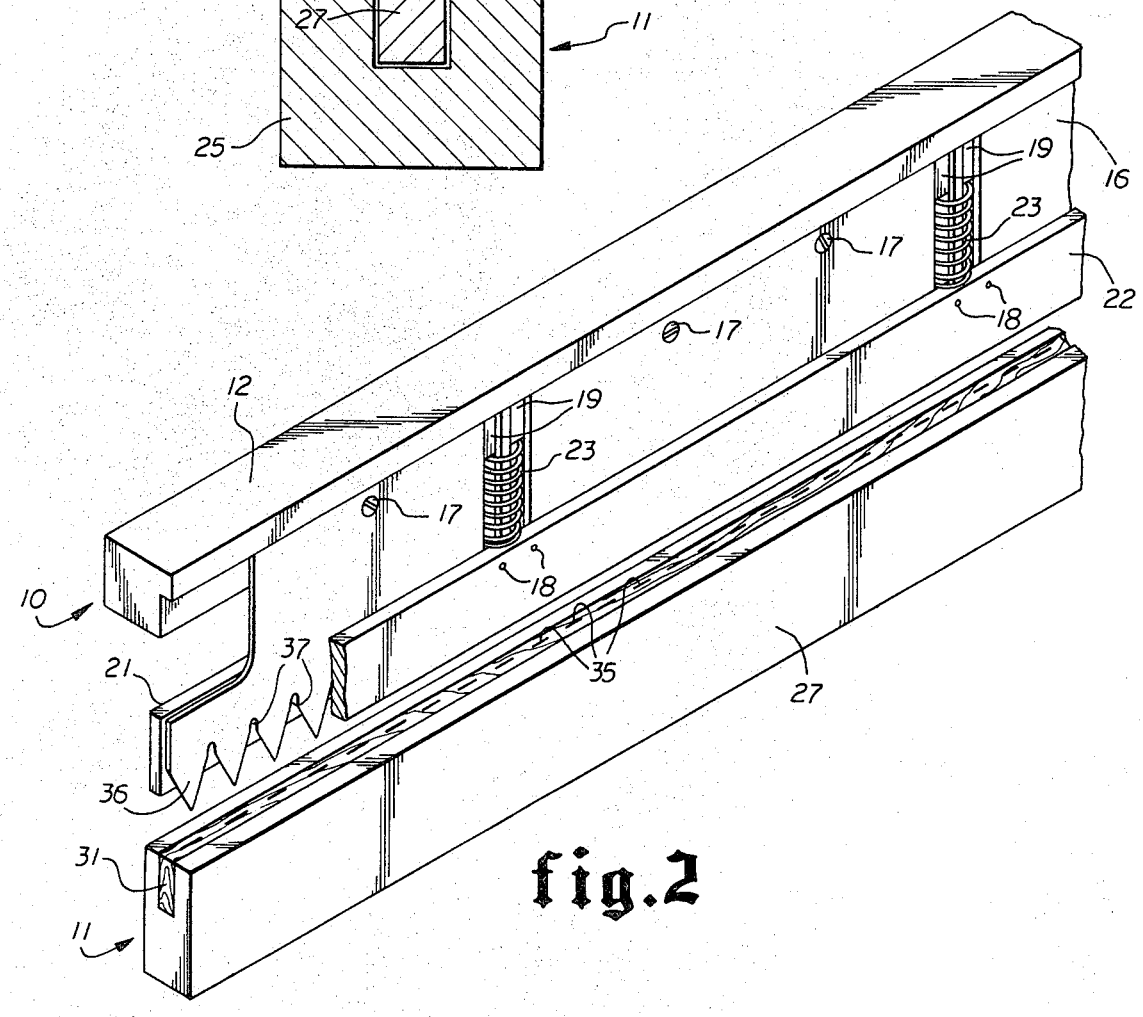
FIG. 2 is a perspective view of the apparatus with portions removed for purposes of illustration.

As best seen in FIG. 2, the blade assembly 13 comprises serrated blade 16, secured to a side portion of head bar 12 by screws 17, and blade guards 21 and 22 flanking blade 16. The blade 16 has formed therein pairs of transverse grooves 19 which extend from the upper edge of blade 16 and terminate above the serrated edge. The guards 21 and 22 are mounted on either side of blade 16 and maintained in position by pins 18. Each pin 18 passes through a groove 19 and has its opposite ends secured to a guard (21 and 22). A compression spring 23 positioned within paired grooves 19 forces the guards 21 and 22 downwardly urging the pins 18 into engagement with the bottom of grooves 19. The upper end of each spring 23 bears against the bottom surface of bar 12.

The upper head assembly 10 is also provided with means for moving the entire head assembly downwardly. The means may take the form of any suitable mechanical, electromechanical, hydraulic, or pneumatic mechanism for activating the head assembly through a cutting stroke. Details of a commercial head actuator may be obtained by reference to the description of the Gloucester Universal Bag Machine or U.S. Pat. No. 3,775,225. For convenience of illustration, the apparatus in FIG. 1 is provided with hydraulic cylinder 24.

As described in more detail below, the head assembly 10 is cooperatively arranged with the bottom bar assembly 11 such that the guards 21 and 22 cover the blade serrated edge and are vertically movable against springs 23 relative to the blade 16 to permit the blade to pierce and penetrate film positioned on the bottom bar assembly 11.

The bar assembly 11 comprises bottom bar 25 having formed therein a T-shaped groove. An elongated channel insert member 27 is positioned in the groove and is flanked by rubber back-up members 28 and 29. The channel of member 27 is aligned to receive the blade and the rubber back-up member 29 is aligned with the heat sealing element 15. The rubber back-up members 28 and 29 also function to maintain the channel member centered in the T-shaped groove.

The upper parallel edges of the channel member 27 are aligned to engage the lower edges of guards 21 and 22. The channel member 27 may be adjusted vertically by means shown in U.S. Pat. No. 3,775,225 to vary the depth of penetration by the blade 16 into channel of member 27.

In accordance with one aspect of the present invention, the channel of member 27 is filled with a soft support material such as a strip of balsa wood 31 which is readily penetrable by the blade, but is sufficiently rigid in the cutting direction to support film thereon. Elongate longitudinally spaced grooves 35 are formed in the support material 31 to receive the cutting blade 16 therein in close conformity. The grooves 35 are formed by placing the support material in channel member 27 and actuating the cutting blade 16 through several cycles. The blade penetrating the readily penetrable material forms self-aligned grooves 35 in the support member 31. A material that has been found particularly suitable for this purpose is balsa wood. The balsa wood is placed in the channel member 27 with the grains orientated substantially in a vertical direction, or in a direction parallel to the plane of the blade 16. The action of the blade 16 in forming the self-aligned grooves 35 deformably penetrates the balsa wood. The vertically oriented grains prevent shredding of the wood.

Referring to FIG. 2, the blade 16 is an elongate member having paired slots 19 formed therein, as described above, to permit installation of the compression springs 23. The serrated cutting edge of the blade 16 comprises teeth 36 and slots 37 which extend in a direction parallel to the direction blade travel 16. The size of the teeth 36 and slots 37 determine the length of perforations in the film. The depth of penetration of the blade 16 into support member 31 is such that a portion of the slots 37 remain above the film at the bottom of the cutting stroke. This feature ensures uniform perforation of the film and substantially reduces the criticality of adjusting the length of cutting stroke.

In a preferred embodiment of the invention, the cutting blades are coated with a hard metal having a hardness of at least Rockwell C 50. A steel blade flash coated with chromium has produced excellent results. The chrome may be electroplated on the blade in accordance with electroplating procedures well known in the art.

In operation, the apparatus without the back-up surface insert 31 is assembled and adjusted to provide the proper cutting stroke. Following this step, the balsa wood insert 31, without grooves formed therein, is positioned in the channel member 27 with the grains orientated substantially vertically. The balsa wood is sized to substantially fill the channel and provide a top planar surface across member 27. The apparatus then is operated through several cutting cycles which causes the blade 16 to penetrate the upper surface of the balsa wood 31, forming grooves 35 therein. In this manner, the balsa wood 31 is provided with grooves 35 that receive the teeth 36 in close conformity such that when film is supported on the balsa wood, the downward action of the blade 16 penetrates it by shearing the film.

With grooves 35 formed in the balsa wood 31, the apparatus is ready for operation. The plastic film (illustrated as 38 in FIG. 1) in the form of flattened tube is indexed through the cutting and sealing apparatus. The indexing apparatus may be as illustrated in U.S. Pat. No. 3,775,225. After each indexing, the head assembly 10 is actuated causing the heat sealing bar 15 to engage the film 38 supported on the rubber back-up member 29 thereby heat sealing the plastic tube. During downward movement of the head assembly 10 causes the blade guards 21 and 22 to contact the upper end of the insert channel member 27 and causes the teeth 36 to penetrate the film 38 and enter the grooves 35 in the balsa wood 31 forming linearly aligned perforations adjacent the sealed strip. The head assembly 10 is then moved upwardly returning it to its retracted position. The plastic film 38 is again indexed moving the web one bag length to the left, (as viewed in FIG. 1), placing the film 38 in the next index position. The cycle is repeated in this manner for each index position. The film may be wound up in a roll or processed through a separator and stacker to make individual bags for packaging in cartons.

The following examples illustrate the effectiveness of the apparatus constructed according to the present invention. A conventional Gloucester Universal Bag Machine was equipped with a conventional steel blade. The channel of member 27 had a width of 3/32 inch and was operated without insert member 31. A 1/32 inch thick segmented steel blade was used in the test. Extruded tubular polyethylene (LLDPE) film was used in the test. The blades became dull after a few operations and the film tension created at the mouth of the channel of member 27 adversely affected the quality of the seal attainable by sealing element 15.

Following this test, a piece of 3/32 inch thick balsa wood shaped to fill the channel of member 27 was inserted with its grains orientated parallel to the plane of the blade 16. The blade was flash coated with chromium and slots (37) 1/32 inch wide and ⅛ inch deep were ground into the blade 16 between adjacent teeth 36. The teeth 36 were of saw tooth construction having height of 3/16 inch and a width of ¼ inch. The blade 16 used in this test was flash coated with chromium by the following procedure. The blades were plate using an emf of 5 volts and a current density of 1.5 Amperes per square inch of surface to be plated, for a period of six minutes. Prior to plating, the current through the bath was reversed for a few seconds (making the blades the anode). This resulted in micro etching of the blade surface assuring good adhesion of the chromium deposit. The electrolyte used was chromic acid (Unichrome HCR 710 by M&T Chemicals). It is believed that the improved results are due to (1) the hard, abrasive resistance of the blade and (2) the film back-up provided by the balsa wood. The chromium flash coating not only provides the necessary hard and resistant material but also provides convex edges at the tip of the blade teeth because of the higher current density per unit area at these locations. The slightly thicker deposition of chromium results in a sharper tooth point. The balsa wood required replacing about every 7 to 10 days but the blade lasted several months in continuous service on LLDPE film.

Based upon the results obtained in the above test, it can be seen that the apparatus constructed according to the present invention substantially increases the blade life and substantially eliminated the problems encountered with the conventional Gloucester Universal Bag Machine.

Although the present invention can be used with particularly advantageous results with linear low density polyethylene, it may also be used with advantage with other types of film. These include low density polyethylene, high density polyethylene, as well as other films used in the manufacture of film products.

What is claimed is:

1. Apparatus for perforating plastic film which comprises:

a metal blade having an elongate serrated cutting edge;

means for reciprocating the blade through a cutting cycle;

a readily penetrable back-up member aligned with cutting blade and having a surface for supporting film thereon and grooves formed therein particularly shaped to receive the serrated cutting edge in close conformity, said grooves being formed by reciprocating said blade through a sufficient number of cycles to permanently shape the grooves in said back-up member by penetration of said blade to a substantial depth;

whereby reciprocation of said blade through a cutting cycle causes the blade to penetrate film supported on said support surface, to enter said particularly shaped grooves, and to return to a retracted position.

2. Apparatus as defined in claim 1 wherein the blade is made of a metal having a hardness of at least Rockwell C 50.

3. Apparatus as defined in claim 1 wherein the blade comprises a metal member having a plurality of teeth and being flash electroplated with chromium to provide the tips of the blade teeth with convex edges to better penetrate the film.

4. Apparatus as defined in claim 1 wherein the blade has formed between at least part of adjacent teeth of the serrated cutting edge slots which extend transversely with respect to the serrated cutting edge, and wherein the cutting stroke is such that a portion of the slots enter the back-up member.

5. Apparatus as defined in claim 4 wherein the back-up member is positioned in relation to the blade such that at least a portion of the slots formed in the blade remain above the back-up member in all positions of the blade through the cutting stroke.

6. Apparatus as defined in claim 1 wherein the back-up member is balsa wood positioned in relation to said blade such that the grains of the balsa wood are aligned parallel to the cutting action of the blade.

7. Apparatus for perforating plastic film which comprises: a serrated metal blade having an elongate serrated cutting edge having a Rockwell hardness of at least C 50, said blade being reciprocable from a retracted position through a cutting stroke; and a soft wood back-up member aligned with the blade for supporting plastic film thereon during the cutting stroke, said back-up member being readily penetrable and deformable by said blade and being sufficiently rigid to provide substantially unyielding support for the film during blade penetration thereof and having grooves of a substantial depth formed therein for receiving the blade by the action of blade penetration thereof.

8. Apparatus as defined in claim 7 wherein the blade serrations are shaped and spaced to perforate the film supported on the back-up surface to provide a longitudinally spaced perforations extending transversely along the film.

9. Apparatus as defined in claim 8 and further comprising a heater element positioned adjacent the blade to heat seal the film adjacent the longitudinally spaced perforations.

10. Apparatus as defined in claim 9 wherein the blade comprises a metal member having a plurality of teeth and flash electroplated with chromium to provide the tips of the blade teeth with convex edges to better penetrate the film.

11. Apparatus as defined in claim 10 wherein the back-up member is balsa wood positioned in relation to said blade such that the grains of the balsa wood are aligned parallel to the cutting action of the blade.

* * * * *